United States Patent [19]

Anderson

[11] Patent Number: 4,754,557

[45] Date of Patent: Jul. 5, 1988

[54] GRAIN DRYER

[76] Inventor: Eilif J. Anderson, 9705 - 56 Avenue, Edmonton, Alberta, Canada, T6E 0B4

[21] Appl. No.: 3,180

[22] Filed: Jan. 14, 1987

[51] Int. Cl.[4] ..... F26B 9/06

[52] U.S. Cl. ..... 34/174; 34/229; 34/232

[58] Field of Search ..... 34/174, 224, 229, 222, 34/232

[56] References Cited

U.S. PATENT DOCUMENTS

| | | | |
|---|---|---|---|
| 3,474,903 | 10/1969 | Ausherman | 34/174 |
| 4,337,584 | 7/1982 | Johnson | 34/174 |
| 4,423,557 | 1/1984 | Westelaken | 34/174 |

*Primary Examiner*—L. I. Schwartz
*Attorney, Agent, or Firm*—G. H. Dunsmuir

[57] ABSTRACT

A relatively compact, streamlined dryer for use in hopper-bottomed grain bins includes a foraminous, cylindrical casing surrounding a foraminous, cylindrical duct, which is coaxial with the casing, the openings of the casing and duct being directed downwardly to reduce the risk of clogging; triangular brackets extending outwardly and downwardly from the casing for pivotally supporting feet so that the dryer can readily be mounted on the sloping floor of a bin over the central discharge opening thereof without substantially impeding the unloading of grain; an inlet duct in the side of the casing for admitting air into the dryer; and a frusto-conical, annular cap on the top end of the dryer closing the top of the passage between the casing and the duct.

7 Claims, 2 Drawing Sheets

GRAIN DRYER

BACKGROUND OF THE INVENTION

This invention relates to a grain dryer, and in particular to a dryer for use in the air drying of grain in bins or silos with inclined bottoms.

The dryer of the present invention is primarily intended for use in bins having a capacity of 2,000 to 10,000 bushels. In general, grain dryers for use in such bins are somewhat bulky structures, which may impede the unloading of the grain through the bottom central discharge opening of the bin. Moreover, care must be taken to ensure that the dryer is sufficiently strong to avoid collapsing during unloading of the bin.

The object of the present invention is to overcome the above-mentioned problems by providing a relatively simple, strong grain dryer, which can be mounted in the centre of a grain bin above the discharge opening without substantially impeding the flow of grain during unloading of the bin.

SUMMARY OF THE INVENTION

Accordingly, the present invention relates to a grain dryer comprising substantially cylindrical foraminous casing means; substantially cylindrical, foraminous duct means coaxial with and spaced apart from the interior of said casing means; spacer means for maintaining the casing means and duct means in spaced apart relationship; annular cap means interconnecting and covering the top of the casing means and the top of said duct means; and inlet means for introducing air under pressure into the space between said casing means and said duct means.

BRIEF DESCRIPTION OF THE DRAWINGS

The invention will now be described in greater detail with reference to the accompanying drawings, which illustrate a preferred embodiment of the invention, and wherein.

DESCRIPTION OF THE PREFERRED EMBODIMENTS

With reference to the drawings, the grain dryer of the present invention includes a foraminous, cylindrical outer casing 1, and a foraminous, cylindrical central duct 2 concentric with the casing 1. Both the casing 1 and the duct 2 are defined by a plurality of overlapping, interconnected panels containing louvers 3 over substantially their entire surfaces, with the exception of small planar rectangular borders 4. The louvers 3 are elongated openings which direct air downwardly and outwardly from the casing 1, and downwardly and inwardly from the duct 2.

Figure 2:
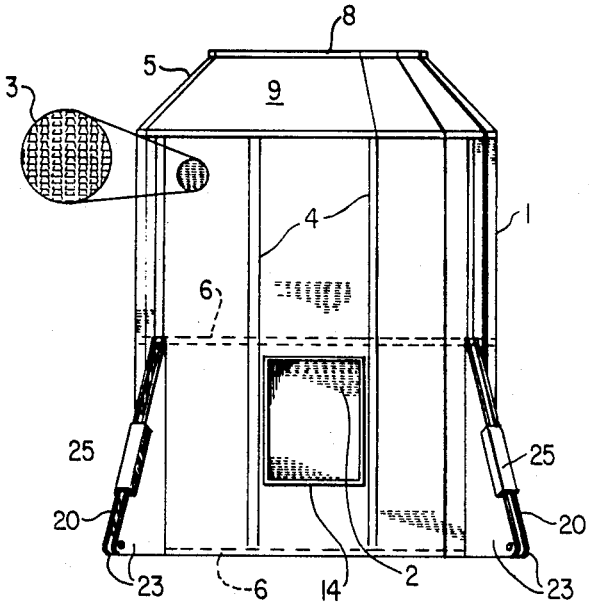
FIG. 2 is a side elevation view of the grain dryer of FIG. 1 with parts omitted.

The casing 1 and the duct 2 are held together by an annular frusto-conical cap 5 and a pair of reinforcing rings 6 (FIG. 2) at the bottom and midpoint of the structure. The cap 5 has a generally inverted V-shaped cross section, and is open at the bottom for retaining the casing 1 and the duct 2 in proper spaced apart relationship. A short annular flange 8 extends downwardly from the bottom edge of the inclined outer wall 9 of the cap 5 around the top end of the casing 1. The cylindrical inner wall 10 of the cap extends from above the top of the inclined outer wall downwardly inside of the top end of the duct 2. Screws or bolts and nuts (not shown) are used to connect the top of the casing 1 to the flange 8 and the top of the duct 2 to the bottom of the inner wall 10 of the cap 5. A square inlet duct 14 is provided in one side of the casing 1 for introducing air from a conventional blower (not shown) into the space between the casing 1 and the duct 2.

Figure 3:
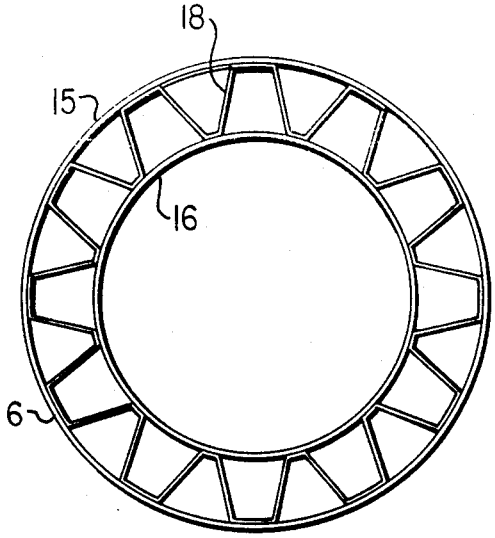
FIG. 3 is a plan view of a reinforcing ring used in the dryer of FIGS. 1 and 2.

With reference to FIG. 3, each reinforcing ring 6 is defined by a pair of concentric, annular metal strips 15 and 16, which are connected together by a third metal strip 18 which defines an annular, essentially square-wave pattern. This arrangement lends high strength to a relatively lightweight, thin walled structure.

Figure 1:
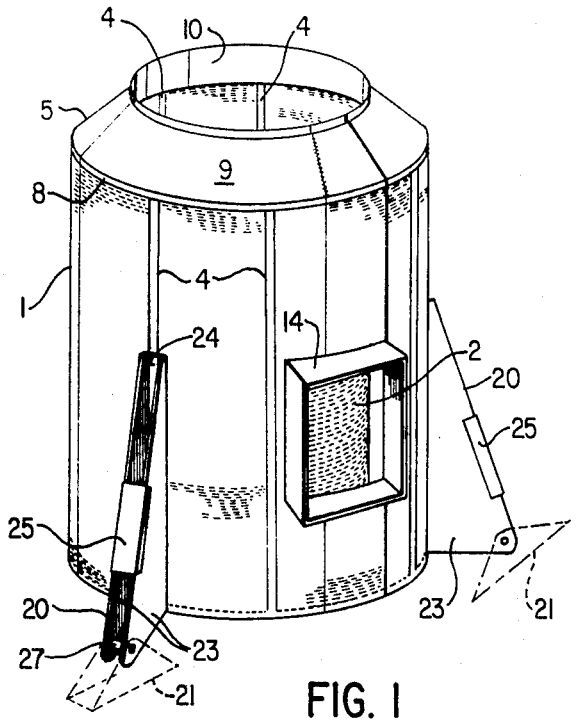
FIG. 1 is a perspective view from above of a 5 grain dryer in accordance with the present invention.
Figure 4:
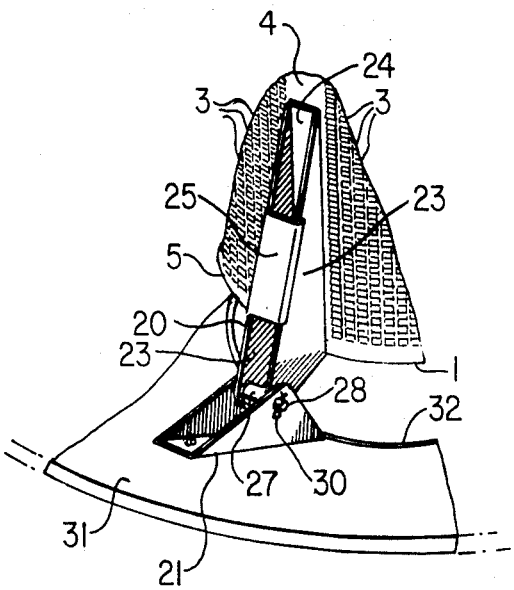
FIG. 4 is a perspective view from above and one side of a foot used in the dryer of FIGS. 1 and 2.

Three generally triangular brackets 20 (FIGS. 1, 2 and 4) are spaced equidistant around the bottom of the casing 1 for pivotally supporting feet 21. Each bracket 20 is defined by a pair of parallel, spaced apart, triangular sides 23, which are interconnected along their longer vertical edges by an inner plate 24, and along their inclined outer edges by a cross plate 25. A small sleeve 27 (FIGS. 1 and 4) is provided at the bottom outer corner of the bracket 20 for receiving a short rod 28 which acts as an axle for the triangular foot 21. The foot 21 is held on the rod 28 by cotter pins 30 (one shown). The foot 21 has a generally U-shaped cross-sectional configuration and when viewed from either side is triangular. As shown in FIG. 4, the feet 21 permit the mounting of the dryer on a grain bin floor 31 having virtually any inclination, so that the longitudinal axis of the duct 2 is aligned with the centre of the grain discharge opening 32 in the floor 31.

In use, the grain dryer is placed on the floor 31 in the bottom centre of a grain bin over the central discharge opening 32. Rectangular tubing (not shown) is used to connect the inlet duct 14 to a blower or fan. When grain is loaded into the bin, the downwardly opening louvers in the casing 1 and the duct 2 prevent clogging of the openings by the grain. The open core structure does not obstruct the natural flow of grain during unloading, and eliminates the danger of collapse during rapid emptying of the bin. Because of the hollow core, the dryer occupies relatively little storage space in the bin. Moreover, the locating of the dryer in the centre of the duct ensures good air distribution.

The dryer of the present invention was specifically designed for use in hopper bottom bins with a capacity of 2,000 to 10,000 bushels, and accordingly the casing and duct are formed of 20 gauge galvanized louvered screen. However, the basic principles underlying the invention can be used in larger or smaller bins.

What is claimed is:

1. A grain dryer/aerator for disposition in grain storage bins or silos comprising substantially cylindrical, foraminous casing means; substantially cylindrical, foraminous duct means coaxial with and spaced apart from the interior of said casing means to define therebetween an open air space of annular configuration; spacer means for maintaining the casing means and duct means in spaced apart relationship; annular cap means interconnecting and covering the top of the annular space defined between the casing means and the duct means so as to leave unobstructed grain storage space interiorly of said duct means and exteriorly of said casing means; and inlet means for introducing air under pressure into the annular space between said casing means and said duct means so as to contact grain both within the duct means as well as within the bin or silo outside of the casing means.

2. A grain dryer according to claim 1 wherein said casing means and said duct means include louvered walls, the openings of which open downwardly when the dryer is in use.

3. A grain dryer according to claim 1, wherein said cap means is substantially frusto-conical including a vertical inner side wall substantially aligned with said duct means and an inclined outer side wall.

4. A grain dryer according to claim 1, including foot means on said casing means for supporting the dryer above a bin floor.

5. A grain dryer according to claim 4 including connector means for pivotally connecting said foot means to said casing means for rotation of the foot means in generally radial planes relative to said annular configuration such that said foot means can be rotated for mounting the dryer adaptably on sloping bin floors of various inclinations.

6. A grain dryer as claimed in claim 1 mounted in a hopper-bottomed grain storage bin.

7. A grain dryer as claimed in claim 5 disposed in a hopper-bottomed grain storage bin and supported by said foot means bearing against the bin floor, the foot means being rotated so as to adapt to and lie against and generally parallel to the inclined hopper-bottomed floor.

* * * * *